US006942494B2

(12) United States Patent
Watson

(10) Patent No.: US 6,942,494 B2
(45) Date of Patent: Sep. 13, 2005

(54) ACTIVE CONFIGURABLE AND STACKABLE INTERFACE CONNECTOR

(76) Inventor: Troy M. Watson, 7052 E. 2nd St., Tucson, AZ (US) 85710

( * ) Notice: Subject to any disclaimer, the term of this patent is extended or adjusted under 35 U.S.C. 154(b) by 151 days.

(21) Appl. No.: 10/609,234

(22) Filed: Jun. 27, 2003

(65) Prior Publication Data

US 2004/0266224 A1 Dec. 30, 2004

(51) Int. Cl.[7] ..... H01R 12/00
(52) U.S. Cl. ..... 439/66
(58) Field of Search ..... 439/66, 65, 91–92, 439/71, 74–75, 591–592, 80–83

(56) References Cited

U.S. PATENT DOCUMENTS

| | | | | | |
|---|---|---|---|---|---|
| 4,992,053 | A | * | 2/1991 | Lindeman et al. | 439/66 |
| 5,042,146 | A | * | 8/1991 | Watson | 29/845 |
| 5,085,590 | A | | 2/1992 | Galloway | |
| 5,167,512 | A | * | 12/1992 | Walkup | 439/66 |
| 5,250,759 | A | | 10/1993 | Watson | |
| 5,755,596 | A | | 5/1998 | Watson | |
| 6,010,342 | A | | 1/2000 | Watson | |
| 6,517,383 | B2 | * | 2/2003 | Watson | 439/608 |
| 6,527,588 | B2 | | 3/2003 | Paagman | |
| 6,540,558 | B1 | | 4/2003 | Paagman | |
| 6,796,810 | B2 | * | 9/2004 | DelPrete et al. | 439/86 |
| 2003/0176083 | A1 | * | 9/2003 | Li et al. | 439/66 |

* cited by examiner

*Primary Examiner*—J. F. Duverne

(57) ABSTRACT

An interface connector system that provides active buffering, amplification, level shifting, filtering, and other functional electronic processing between one side of the connector and the opposing side. In addition, the local generation of electrical stimulus and signals can be provided on one side of the connector. Modules are installed into a housing for each signal pin at manufacture to perform a specific function. The housing populated with the modules is inserted between a circuit board or connector of a cable assembly on one side and integrated circuit, multi-chip module or another cable connector on the other side. The signals that transit between the two sides are electrically processed. Since the functionality is provided from one side to the next, modules can be stacked to enable multiple processes as the signal transitions from one connector to the next connector. The signal transitions through the interface connector between any combination of printed wiring board, integrated circuit, multi-chip module, system on a chip (SOC), or cable-assembly. By inserting the connector in-line, short connections are provided, hence inductance and capacitance are decreased thereby improving high-speed and RF performance while decreasing noise generation or pickup. The housing of the connector not only mechanically supports the individual modules but also can supply power, grounds and otherwise interconnect the modules. The modules, whose outer profile closely matches the profile of the housing openings can have the powers, grounds and other signals bonded to the conductive layers of the housing by heating the assembly to thereby flow the pre-applied solder or by compression fitting, either by pressing or thermal fitting.

22 Claims, 5 Drawing Sheets

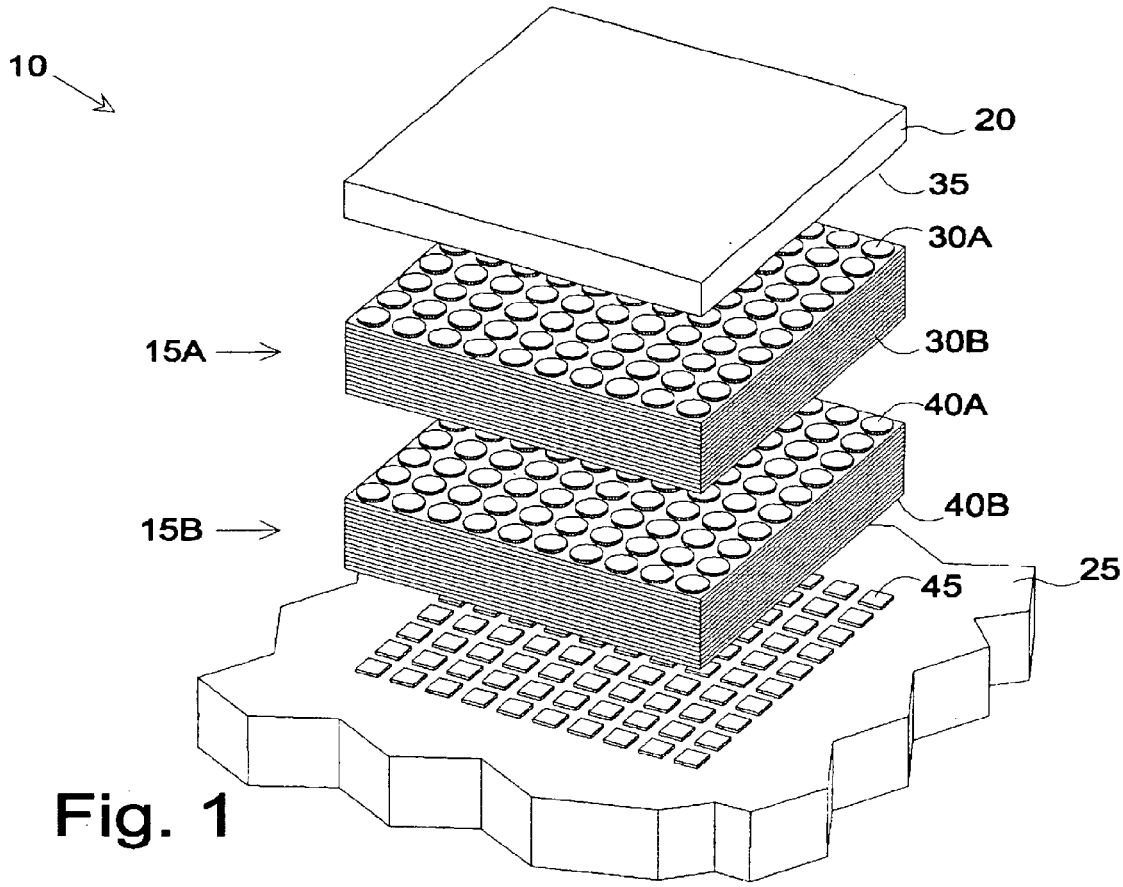
Fig. 1
Fig. 2
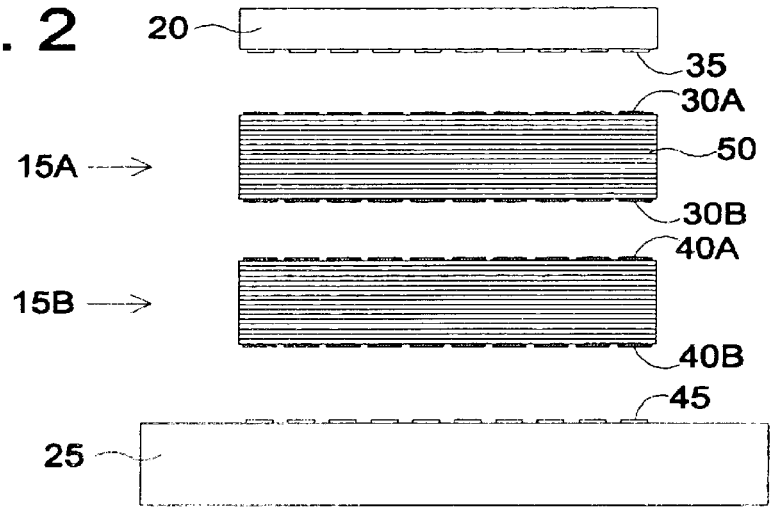

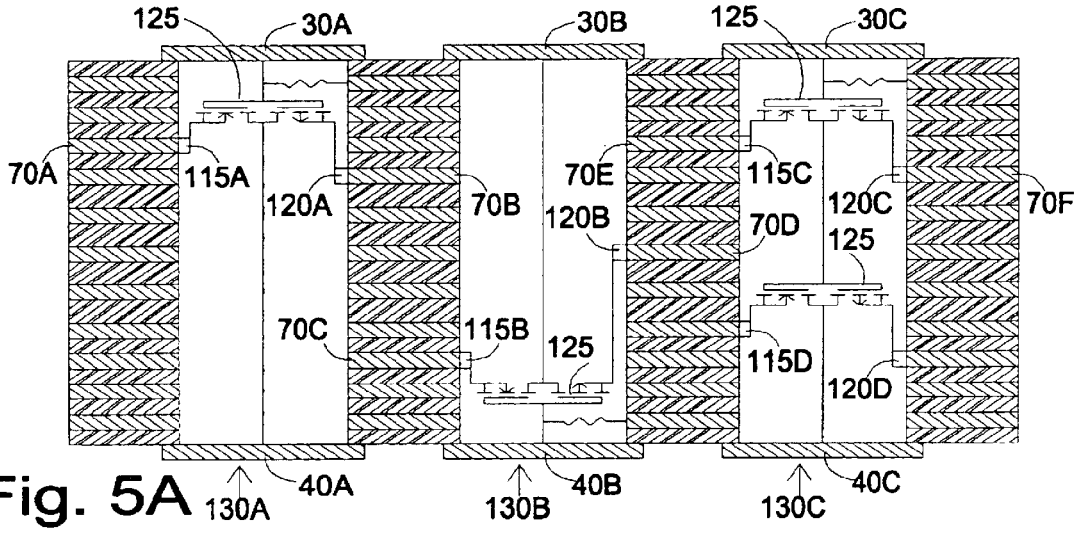
Fig. 5A
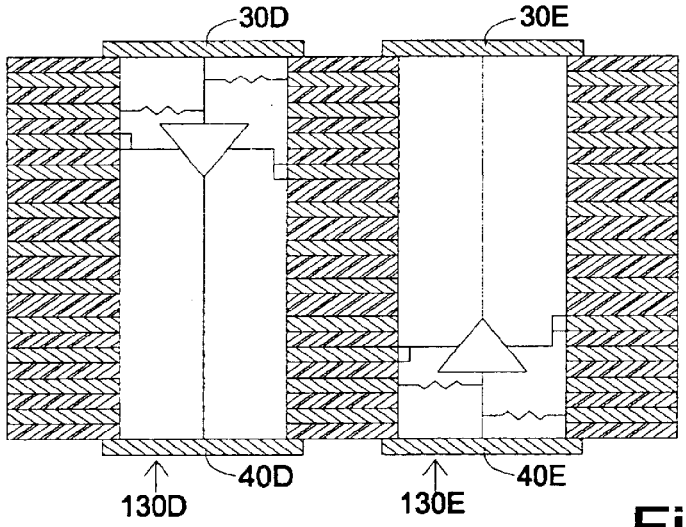
Fig. 5B
Fig. 5C
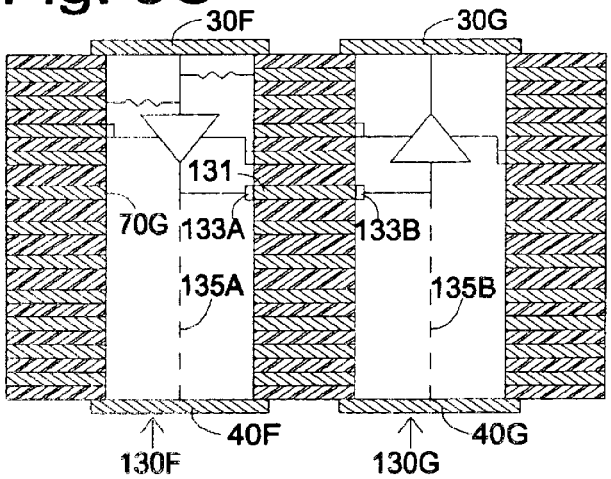
Fig. 5D
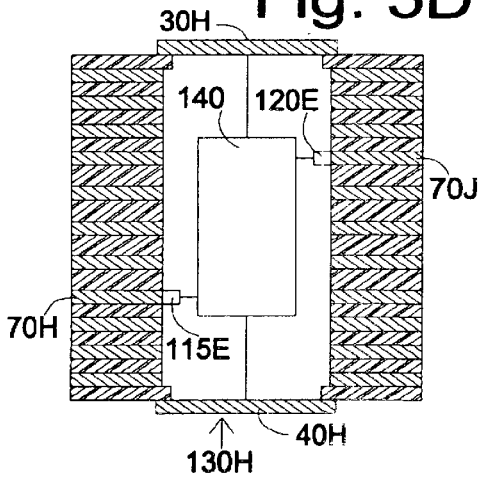

Fig. 6A
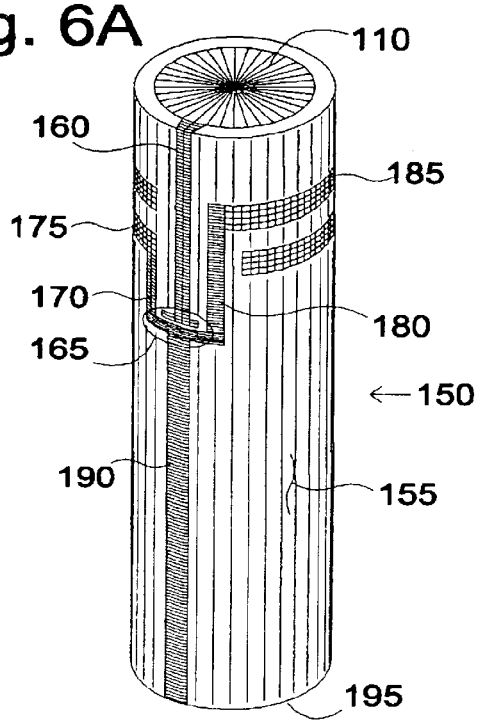
Fig. 6B
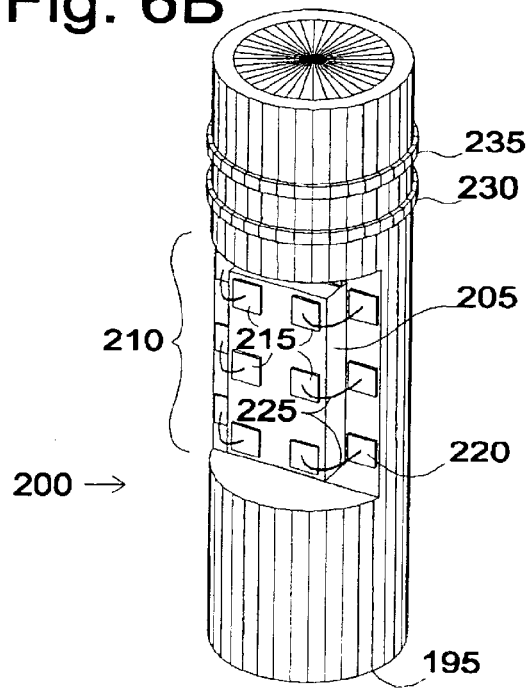
Fig. 6D
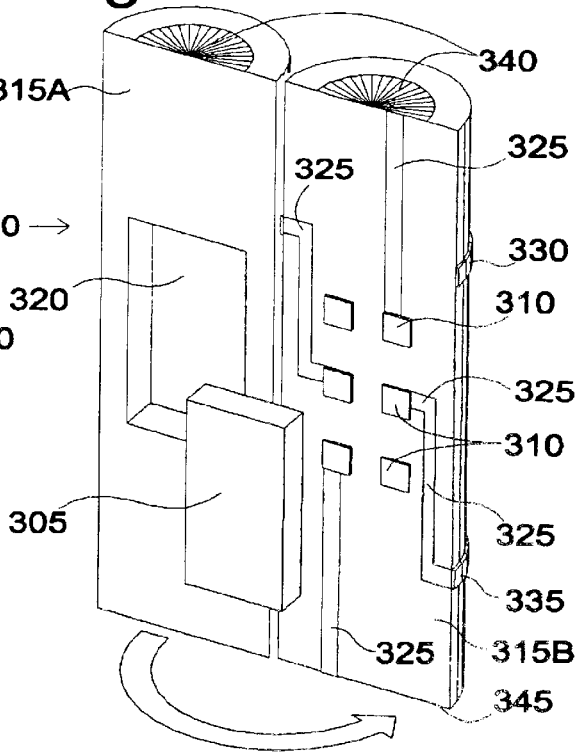
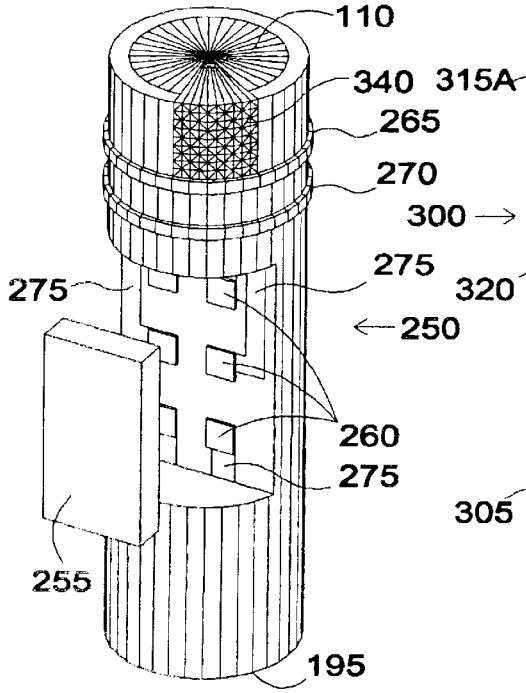
Fig. 6C

ACTIVE CONFIGURABLE AND STACKABLE INTERFACE CONNECTOR

FIELD OF THE INVENTION

The present invention is in the field of electronic/electrical connectors and systems capable of handling high frequencies and providing low-noise while also providing low capacitance, low-inductance with minimal loading. More particularly, the invention relates to multi-connector assemblies in high density arrays including connectors being used as an interposer between high-density and/or miniaturized electronic devices and circuit board assemblies.

Known Art

Present trends in designing microelectronic devices and circuits are toward increased miniaturization, higher component density and greater number of component leads per piece-part that are also capable of being configured in high-density, large-number arrays. Such interconnections must be capable of supporting low-noise signals, signals with fast edges ($\Delta v/\Delta t$) or radio-frequencies (RF) signals. In addition, there is more of a need to provide signal buffering, conditioning, filtering or signal termination to reduce parasitic inductance and capacitance. Techniques known in the art for providing high-density interconnections between an integrated circuit (IC) or multi-chip module (MCM) and a printed wiring board (PWB) include using land grid arrays (LGA's), ball grid arrays (BGA's), and flip-chip techniques. LGA's and BGA's have become popular in part because production equipment used to mount and solder surface-mount devices onto circuit boards can be easily adapted. This ease of manufacture is enhanced by the tendency of BGAs during soldering to self-align because of the effects of surface tension caused from the molten solder. Flip-chip techniques provide the lower inductance for getting signals in and out of IC's and MCM's since thereby allowing higher frequencies and less generated noise.

As electronic devices and integrated circuits are becoming more complex with increasing signal densities, increasing speeds and with decreasing signal voltage levels, there is a corresponding need to improve signal integrity issues and reduce noise. Consequently, there is an increasing need to provide interconnections with a minimal amount of permutations to reduce generated noise. Such permutations include interconnecting stub lengths and changes in characteristic impedance caused from physical transitions within the connector. In addition, short connections are required to reduce interconnecting inductance and capacitance and to also decrease attenuation at higher frequencies. With this need to accommodate increasing speeds and densities in environments of decreasing voltage levels, there is a need to increase functionality and flexibility within the connector while maintaining or improving signal integrity issues and low noise operation. Such functionality and flexibility include signal buffering, amplification, level-shifting or many miscellaneous functions to include voltage regulation, signal generation (an oscillator) or phase-lock loops.

Description of Known Art

U.S. Pat. No. 5,085,590 issued to Michael D. Galloway entitled SHIELDED STACKABLE CONNECTOR ASSEMBLY describes a way to stack contact elements that are shielded from adjacent contact elements and supported by brackets. Even though this connector provides a means to stack contacts the structure is restricted to printed circuit boards, does not lend itself to high density nor does it incorporate any active devices to provide a means to isolate, condition or process signals between connecting members or provide a means to incorporate signal generation.

U.S. Pat. Nos. 6,540,558 B1 and B2 issued to Bernardus L. F. Paagman entitled CONNECTOR, PREFERABLY A RIGHT ANGLE CONNECTOR, WITH INTEGRATED PCB ASSEMBLY and ELECTRICAL CONNECTOR WITH INTEGRATED PCB ASSEMBLY consist of contact units mounted on perpendicular printed circuit boards that are stacked together to form an array of contact units. It cannot provide in-line interconnections between signals, and, even though this connector can be adapted to higher density it also does not provide a means to incorporate active circuitry.

U.S. Pat. No. 5,042,146 ('146) entitled METHOD AND APPARATUS OF MAKING AN ELECTRICAL INTERCONNECTION ON A CIRCUIT BOARD by the present inventor, discloses a process and apparatus for forming double-helix contact receptacles directly from insulated wire for interconnecting components independent of printed circuitry. Some of the apparatus disclosed therein, specifically the wire processing mechanism including cutting, stripping, and handling assemblies, is readily adaptable to the present invention which, like the '146' patent, is capable of handling and incorporating both single and twisted-pair insulated wire. Alternatively, coaxial cable can be used with the center conductor in lieu of a single conductor, provided the shield does not contact the center conductor.

U.S. Pat. No. 5,250,759 ('759), also by the present inventor, for SURFACE MOUNT COMPONENT PADS, is incorporated herein by reference in its entirety; '759 discloses a method to form pads for surface-mount electronic components by inserting a stripped portion of insulated wire into an elongated rectangular opening, and anchoring the U-shaped loop thus formed into place with epoxy or a plug. Although the pads disclosed in the '759 patents can be used with area arrays, their elongated pads will not mesh well geometrically with the square pads normally used in arrays. In addition, due to their shape, elongated pads cannot be disposed sufficiently dense in planar arrays to meet the close proximity requirements of LGA's or BGA's.

U.S. Pat. No. 5,755,596, also by the present inventor, for a HIGH-DENSITY COMPRESSION CONNECTOR, also incorporated herein by reference in its entirety, discloses a method to form contact receptacles for high-density area arrays and connectors from sections of insulated wire. In this patent a stripped section of insulated wire is formed into a short loop, this loop inserted into an insulating sleeve, and this insulating sleeve is inserted into a receptacle of a housing. In an allowed continuation-in-part of '596, entitled SLEEVELESS HIGH-DENSITY COMPRESSION CONNECTOR, the insulation portion of insulated wire takes the place of the insulating sleeve.

U.S. Pat. No. 6,010,342 also by the present inventor, for a SLEEVELESS HIGH-DENSITY COMPRESSION CONNECTOR, also incorporated herein by reference in its entirety, discloses a method to form contact receptacles for high-density area arrays and connectors from sections of insulated wire, but does not use the sleeve of the '596 patent. This patent, also using a stripped section of insulated wire to form an interconnecting loop, is inserted into an insulating housing.

U.S. Pat. No. 6,517,383, also by the present inventor, for a IMPEDANCE CONTROLLED HIGH-DENSITY COMPRESSION CONNECTOR, and also incorporated herein by reference, discloses a method to fabricate an impedance-controlled element within a high-density connector array by the insertion of central plugs into a metal housing, where this connector is capable of incorporating series and parallel resistive elements into each connector element.

The above referenced U.S. Pat. Nos. '146, '626, '759, '342 and '596, are cited for the use of insulated wire to interconnect formed component receptacles; they cannot be stacked or incorporate active circuitry. Although U.S. Pat. No. 6,517,383 and the present invention are similar in construction, U.S. Pat. No. 6,517,383 incorporates a metal housing and neither provides for intermediate connections within the connector nor does it support any active circuitry but instead incorporates passive devices for the central element.

BACKGROUND OF THE INVENTION

For purposes of the present disclosure, passive components are defined as components that have no source of power other than the input signal(s), e.g. resistors, capacitors, inductors and transformers, while "active" as used herein is intended as defined in the McGraw Hill Dictionary of Scientific and Technical Terms: "a component such as an electron tube or transistor that is capable of amplifying the current or voltage in a circuit", which is reasonably assumed to include integrated circuits, and as defined in the IEEE Standard Dictionary of Electrical and Electronics Terms relating to "active" transducers: "A transducer whose output waves are dependent upon sources of power, apart from that supplied by any of the actuating waves."

Passive components typically have two terminals that constitute two distinct nodes in an electrical circuit, as distinguished from a conductor whose two ends constitute only a single node. While it is possible to operate an active device with only two terminals by utilizing special "phantom" powering techniques, typical active devices have at least three of the following terminals: − DC power, + DC power, input (amplifier), output (amplifier or signal source) and common ground (optionally combined with one DC power terminal).

The present invention is directed to utilizing advanced discrete and/or surface deposition implementations to meet the stringent requirements of compact interface connection assemblies and associated modules incorporating state-of-the art high frequency analog and/or high speed digital active devices, along with the capability of also readily incorporating passive components as required.

OBJECTS OF THE INVENTION

It is a primary object of the present invention to provide a multi-unit connector assembly providing a means to reduce signal degradation within any signal's interconnect by buffering or isolating a signal adjacent to the input of an electronic device.

It is another object to provide an ability to process a signal being input or output from an electronic device.

Another object is to provide a multi-unit connector assembly capable of stacking, thereby providing increasing functionality to the electronic device.

Another object is to provide a multi-unit connector that is simple to manufacture.

Another object is to achieve high density and ability to interconnect to microelectronic circuits such as area-arrayed electronic devices including ball-grid arrays, land-grid array, chip-scale or flip-chip packages.

Yet another object is to provide a multi-unit connector that is capable of generating a signal for input to an electronic device.

SUMMARY OF THE INVENTION

These and other objects are achieved by the present invention, a compression-contact connector assembly having a plurality of cylindrical electronic active elements mounted in an array of cylindrical through-openings in a housing panel. The housing panel incorporates alternating layers of traces or planes of electrically conductive material separated by layers of dielectric material. These layers of electrically conductive material provide power and ground to the connector elements while traces of conductive material etched in the conductive layers can serve to interconnect the connector elements. The active connector elements can include digital or analog, differential or single-ended drivers or receivers. Digital devices can include latches, logic gates, level-shifting devices (for translating voltage levels from one logic family to another) and analog devices can include signal, RF or power transistors, voltage regulators, phase-lock loops, or any type of amplifier. In fact, for the purpose of this disclosure the term active refers to the use of any semiconductor or a device for the generation of a signal, such as oscillators or transducers. Essentially, what differentiates this interface connector from other types of connectors, interface or otherwise, is that active modules are inserted internal to the housing with each module preselected and installed into individual openings of the housing for the needed functionality. This arrangement ultimately matches the layout of the interfacing device, such as an integrated circuit, multi-chip module, system on a chip (SOC) or a connector of a cable assembly. The connector array is typically situated between a circuit board and integrated circuit or alternatively can be stacked with multiple units between the circuit board and integrated circuit. This stacking can serve to process one or more of the signals as they transition each connector array. In addition the present invention can be used as an interposer between two connector assemblies as described in U.S. Pat. Nos. "759, '596, '383 or '342.

BRIEF DESCRIPTION OF THE DRAWINGS

FIG. 1 is an exploded three-dimensional view of two connector assemblies showing two interface connectors sandwiched between a printed circuit board and a land-grid array integrated circuit.

FIG. 2 is a side view of the exploded three-dimensional view of FIG. 1 to further detail the interconnect pads of the lower surface of the interface connectors.

FIG. 5A is a side view of an interface connector showing CMOS buffers and level shifting buffers.

FIG. 5B shoes the implementation of operational amplifier configured in opposing input/output profiles.

FIG. 5C is a side view of a possible arrangement of a connector assembly where the intermediate layers interconnect two modules.

FIG. 5D is a side view of a module of a connector assembly containing a voltage regulator, oscillator or other functional module.

FIG. 6A is a 3-D view of a module of a connector assembly containing a surface deposited circuit.

FIG. 6B is a 3-D view of a module of a connector assembly containing an integrated circuit module that is wire-bonded to internal interconnecting traces.

FIG. 6C is a 3-D view of a module of a connector assembly containing an integrated circuit module that is connected to internal interconnecting traces and using direct-chip attach techniques.

FIG. 6D is a 3-D view of an alternate method of incorporating an integrated circuit into the module having a cavity to accommodate the integrated circuit.

DETAILED DESCRIPTION

Figure 3:
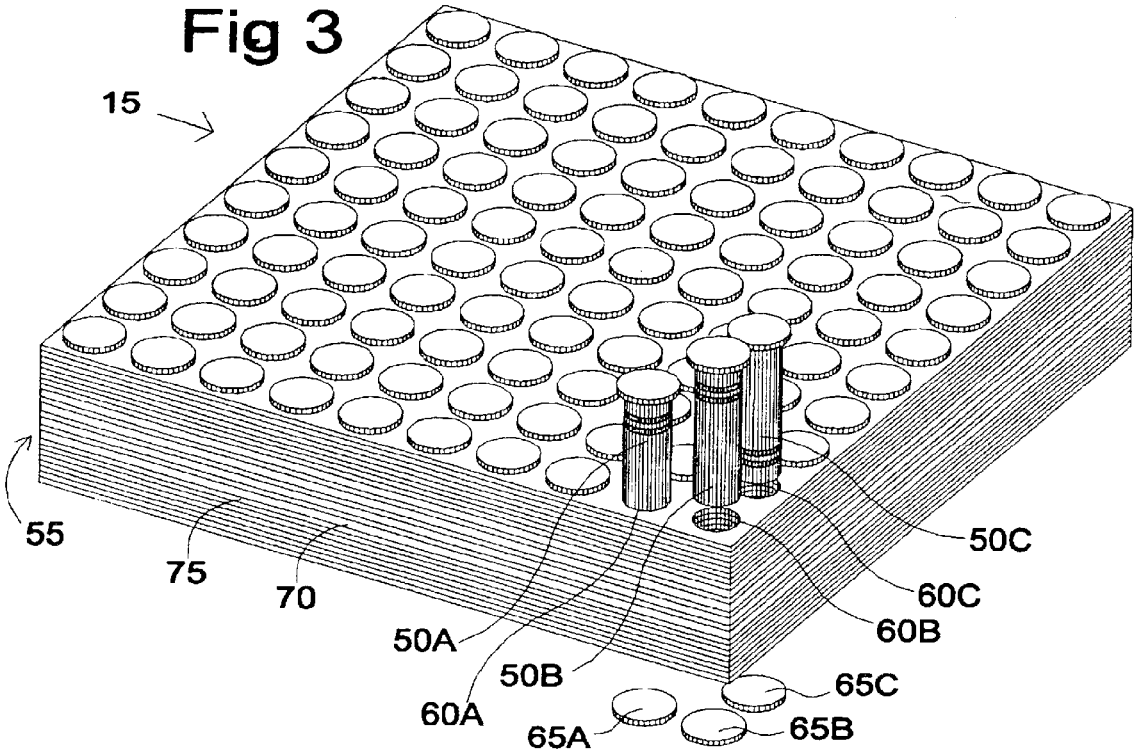
FIG. 3 shows a 10×10 array of the present invention with three forward modules slightly elevated.

FIG. 1 shows an exploded three-dimensional view of a complete stacked interface connector system 10 that, in this scenario, consist of two interface connector assemblies 15A and 15B that are sandwiched between an area array electronic package 20 which can consist of a land-grid/ball-grid/column-grid array device and circuit board 25. Interface connectors 15A and 15B interface and connect area array 20 to circuit board 25. As partially detailed in FIG. 1 but best seen in FIG. 2 (the side view of FIG. 1) pad 30A of interface connector 15A connects to pad 35 of area array 20, pad 30B of interface connector 15A connects to pad 40A of interface connector 15B and pad 40B of interface connector 15B connects to pad 45 of circuit board 25. Other scenarios as an alternative for system 10 can consist of just one interface connector assembly (either 15A or 15B) or alternatively three or more interface connector assemblies (to make 15C, 15D, etc.—not shown) between area array 20 and circuit board 25.

FIG. 3 shows interface connector assembly 15 with three forward interface connector modules 50A, 50B and 50C that are elevated from housing 55. Each module is retained in separate cavities within housing 55 and thus modules 50A, 50B and 50C are retained in cavities 60A, 60B, and 60C. Optional lower end caps 65A, 65B and 65C which in this figure are separated from modules 50A, 50B and 50C provide the mechanical and electrical interface to the opposing contact (not shown). Housing 55 is constructed of alternating layers of electrical conductive material 70 and dielectric material 75 and can be similar in construction to that used within printed-circuit boards. The layers of electrically conductive material can be used to supply electrical power and grounds to the modules or be used to interconnect the modules with etched traces of conductive material. The dielectric material can serve to separate the power and ground planes or can be used to separate a trace from a reference plane as used with signal traces in a strip-line or micro-strip configuration, thereby providing interconnecting one or more modules with traces of a pre-determined characteristic impedance. During manufacture, specific modules (60A, 60B, 60C, etc.) are inserted into predetermined locations within interface connector assembly 15, where the function of each nodule is determined by the particular function needed at that location. The modules are retained within the cavities of interface connector assembly 15 by epoxy or can be pressed-fit into place.

Figure 4A:
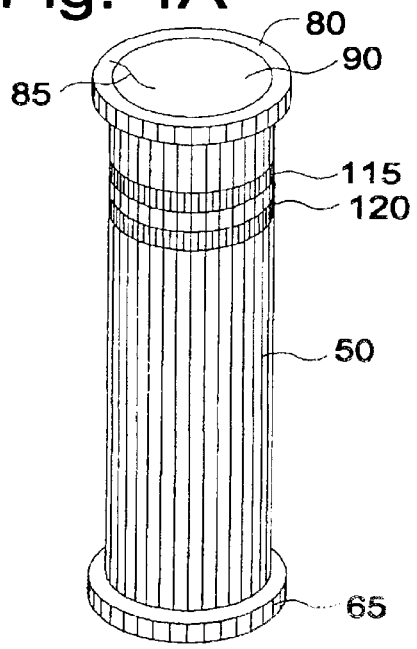
FIG. 4A is an enlarged view of the modules of FIG. 3, complete with optional end caps.

FIG. 4A shows a interface connector module 50 with end caps 65 and 80 attached. The entire surface area 85 of the end cap can be conductive or a confined area 90 can be the only conductive area. A limited conductive area may be necessary under certain conditions, such as if end caps 80 touch each other or to electrically isolate the caps from an conductive surface of the interface connector assembly. End caps 65 and 80 can help increase the conductive area to contact an opposing contact area or can be used to help retain module 50 within housing 55. The conductive contact surface can also be plated with a noble metal in order to impede oxidation of the contact surface.

Figure 4B:
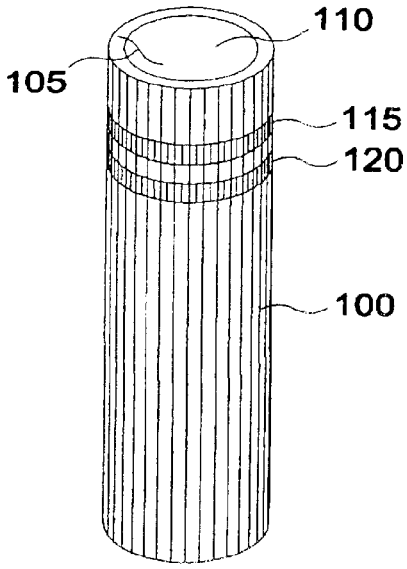
FIG. 4B is the module of FIG. 4A with the optional end-caps removed.

FIG. 4B shows an alternate interface connector module 100 without end caps 65 and 80 of FIG. 4A. Module 100 can be an alternative to module 50 but at a cost of losing conductive surface area or a means of retaining the module. As with end cap 80 of module 50, the entire surface area 105 can be conductive or the conductive area can be confined to an area 110. In both modules 50 and 100 of FIG. 4A and FIG. 4B conductive bands 115 and 120 provide an electrical interface between one of the conductive planes 70 of housing 55 and modules 50 and 100, wherein they are connected to transfer power, ground, or signals between housing 55 and the modules. Each module consists of a minimum of two or more connection bands in order to supply power to any active device (e.g. VCC and ground) and additional bands would be required to connect to additional traces within the housing. Bands 115 and 120 are bonded to one of the conductive layers 70 during manufacture either by an air-tight press fit, a conductive epoxy, or by the use of solder. When using the solder technique, one possible method is to pre-deposited solder onto conductive bands 115 and 120 of the modules and inserting the modules into the cavities of housing 55 after which the assembly is elevated in temperature to flow the solder, thereby electrically bonding conductive bands 115 and 120 to the conductive layers 70. The cavity which retains a module can be unkeyed (e.g. circular) to allow unfettered rotational positioning of the module within the cavity or be keyed to provide specific positioning of the module within the cavity, thereby enabling bands 115 or 120 to contact conductive plane 70 only at a specific location.

FIG. 5A through FIG. 5D are sectioned side views of different functional configurations of modules represented with electronic schematic symbols that are situated within housing 55 of FIG. 3.

FIG. 5A is a sectioned side view of a interface connector assembly showing circuit schematics of three types of modules consisting of a type CMOS FET transistor buffer 125. In module 130A the flow of the signal is from end cap 30A to end cap 40A while in module 130B the signal flow is from 40B to 30B. Module 130C consists of two stages of CMOS FET transistors where input logic level at end cap 30C is translated to a different logic level at the output at end cap 40C. Such a two-stage buffer can be used for level shifting from one logic family to another, such as from TTL to PECL or vise-versa. Power and ground for modules 130A, 130B and 130C are tapped off through conductive bands at 115A, 120A, 115B, 120B, 115C, 120C, and 115D, 120D. In module 130A the positive connection is transferred from the conductive plane at 70A to the source of the FET via conductive band 115A and the negative or ground connection is from conductive plane 70B via conductive band 120A. In module 130B the negative or ground connection is transferred from the conductive plane at 70C to the source of the FET via conductive band 115B and the positive connection is from conductive plane 70D via conductive band 120B. All power and ground connections to bias the active devices in the modules are connected in a similar manner, except the particular planes to which the active devices are connected are dependent on the voltage levels at which the active devices require and the pre-determined arrangement of the stack-up of the planes.

FIG. 5B is a sectioned side view of a interface connector assembly schematic showing two modules consisting of two analog amplifiers. Module 130D serves as an output buffer where the signal flow goes from end cap 30D to end cap 40D and module 130E serves as an input amplifier where the signal flow goes from end cap 40E to end cap 30E. Operational amplifiers 130D and 130E can include any type of analog amplifier including a generic operational amplifier, instrumentation amplifier, trans-impedance amplifier or isolation amplifier.

FIG. 5C shows a sectioned side view of a interface connector assembly schematic where modules 130F and 130G are interconnected through trace 131 within conductive layer 70G. Within module 130F a signal enters cap 30F from the interconnecting electronic package, connector or circuit board, is buffered with an active device in module 130F, enters trace 131 from contact 133A, enters the active device in module 130G from contact 133B, and is then output from the active device in module 130G. From active device in module 130G the signal then reenters the interconnecting electronic package, connector or circuit board at cap 30G. Within modules 130F and 130G the signal exiting the active device of module 130F or being input into module 130G can optionally connect to pads 40F and 40G as indicated with connections represented with the dashed lines 135A or 135B. Other applications of using a conductive trace 131 within one of the conductive layers not only can convey data information but also can convey control signals, such as a device enable, 3-state enable, reset, strobe, or any other control functions.

FIG. 5D shows a sectioned side view of a module 130H that represents any active device, as designated with a box at 140. Module 130H can output at 30H and having an optional input at 40H or alternatively can output at 40H and having an optional input at 30H. Module 130H can be a voltage regulator, a voltage reference, a delay line, a one-shot, a logical inverter, or any other active function that receives their input at either cap 30H or 40H and output at the opposing cap. Module 130H can also be an output-only device such as a temperature transducer or an oscillator, where power and ground are connected to conductive planes 70H and 70J via connections 115E and 120E and the output can exist at either cap 30H or 40H. The voltage regulator and voltage reference can also function as an output-only device (the input-end not used) when the voltage is input from conductive planes 70H and 70J via connections 115E or 120E.

FIGS. 6A through 6D and FIG. 7 show different methods of implementing active circuitry into or onto a module. In each of these methods caps 30, 40, 65 or 80 may be included to connect to the opposing connection point/contact or optionally be not included, as shown.

FIG. 6A shows module 150 which is one method to implement active circuitry onto a module. Module 150 has a CMOS FET transistor deposited on the surface and can be similar in function to the CMOS FET of module 130A in FIG. 5A. In this representation, one layer of deposition is shown on surface 155 of module 150. In practice multiple layers can be sequentially deposited to increase the complexity and functionality of the module. As shown on module 150, conductor 160 connects end conductive pad area 110 to the gate region 165. Conductor 170 transfers current from one of the conductive bands at 175 to one of the source terminal of the CMOS FET and conductor 180 transfers current from the conductive band at 185 to the other source terminal of the CMOS FET connection. The drain terminals of the CMOS FET are tied together and connected to conductive trace 190 which connects the drain terminals to conductive metal 195 (not visible in this view) at the end of the module. This conductive metal 195 at the end of the module in turn connects to the next module, circuit board pad or the pad of the electronic package.

FIG. 6B shows another method to apply active circuitry within a module. Module 200 retains an active device 205 within slot 210 of the module where pad 215 of the active device connects to pad 220 of the module through wire bonds 225. Internal interconnections within the module (not shown) connect conductive bands 230 and 235 to the appropriate pads of the active device 205. In addition, end conductive pad area 110 and end conductive pad area 195 (not visible in this view) each have a connection to one of the pads 220 (these connection also are not shown).

FIG. 6C shows module 250, yet another method to apply active circuitry within a module, where active device 255 is shown elevated away from module 250 in order to better view the pads of the device and module. Interconnecting pads located on the bottom of active device 255 (pads not shown) are placed against pads 260 of the module and are electrically connected using direct-chip attach or flip-chip methods. Direct-chip attach and flip-chip attachment methodology are known in the electronics industry and the are an alternative to wire bonding techniques when bonding electronic packages to a circuit board or a substrate. As with module 200 of FIG. 6B internal interconnections within the module (interconnections are not shown) connect conductive bands 265 and 270 to the appropriate pads of the active device 255 and end conductive pad area 110 and end conductive pad area 195 (not visible in this view) each have a connection to one of the pads 260 through one of the conductive traces 275.

FIG. 6D is an exploded view of module 300 which is yet another method to implement active circuitry within a module. Active device 305 as shown is elevated away from module 300 with the pads for the active device (device pads are not shown) that connects to module pads 310 with the use of direct-chip attach or flip-chip techniques, in a manner similar to that of module 250. In module 300, module half 315A folds onto module half 315B, with active device 305 residing within cavity 320. Internal interconnecting traces 325 connects module pads 310 of the module to conductive band 330 and conductive band 335, while also connecting module pad 310 to end conductive pad area 340 and end conductive pad area 345 (not visible in this view).

Active circuitry and supporting circuitry can be implemented within modules by a combination of deposition as with module 150 of FIG. 6A and the use of a package as with modules 200, 250 and 300 in FIGS. 6B, 6C and 6D. As an example, the crosshatched area 340 of FIG. 6C is a resistive load and can be deposited between interconnect area 110 and conductive band 265. Other types of circuitry including semiconductor can be deposited onto the module 250 to add or increase functionality.

Figure 7:
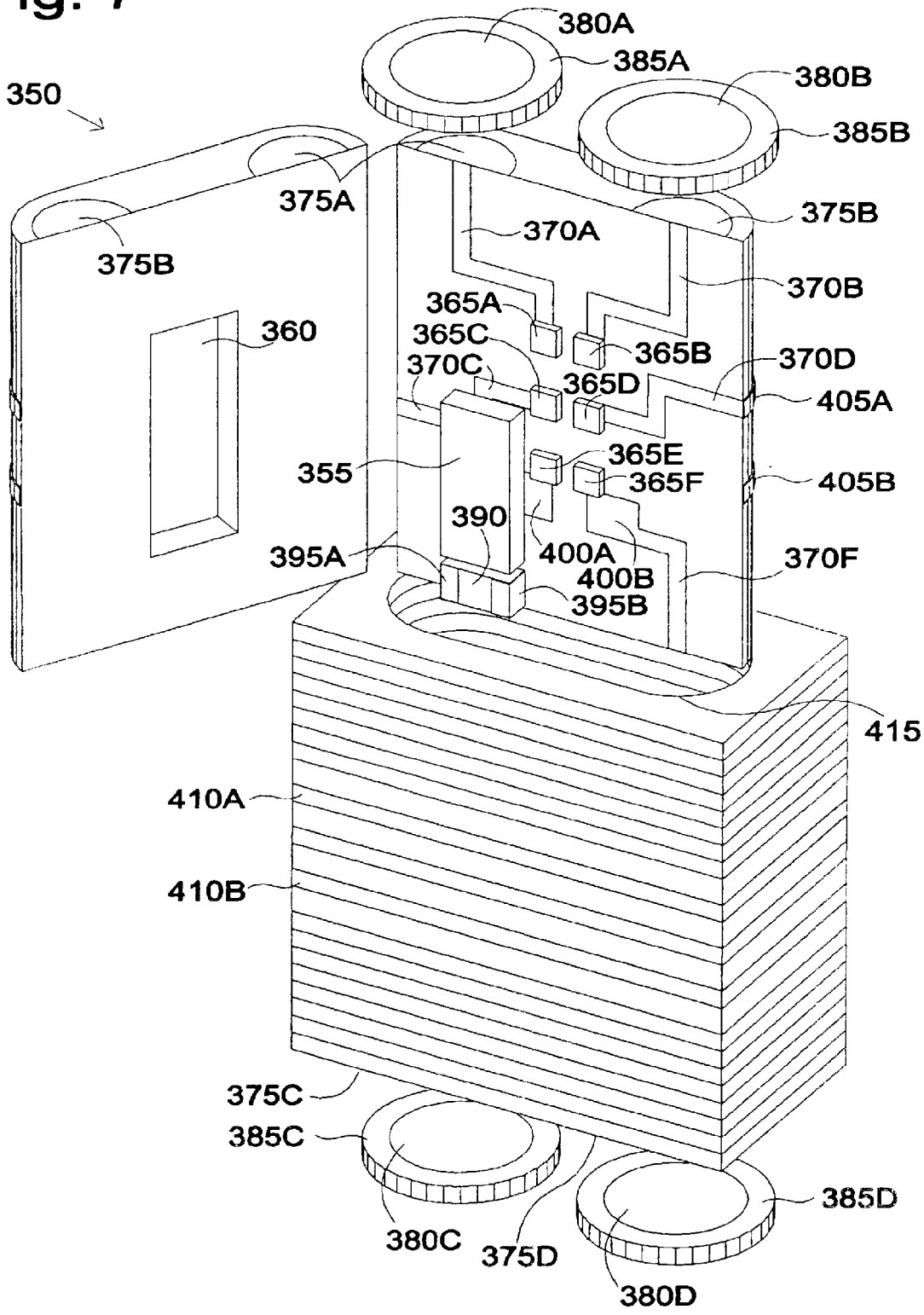
FIG. 7 shows a module having capability to access two signals to support dual-signal functions, such as differential amplifies or phase-lock loops.

FIG. 7 shows module 350 which is adapted to the output of differential signals and optionally the input of differential signals. As with active device 305 of module 300 residing within cavity 320, the active device 355 of module 350 resides within cavity 360 and the pads of active device 355 (pads not shown) directly attached to module pads 365A through 365F. Alternative implementations for active circuit implementations can deposit active circuitry onto the surface of module 350 similar to that as implemented with module 150 of FIG. 6A. In this instance for module 350 interconnecting pads 365A, 365B 365E and 365F respectively connect to traces 370A, 370B, 370E, 370F (trace 370E not shown) which in turn respectively connects to pads 375A, 375B, 375C, and 375D (pads 375C and 375D are not shown) which in turn respectively connect to conductive areas 380A, 380B, 380C, and 380D of caps 385A, 385B, 385C and 385D. Also shown with active device 355 is a resistive load 390 having pads 395A and 395B which are respectively connected to pads 400A and 400B which in turn connects to module pads 365E and 365F. To transfer power and return current connections to active device 355, conductive traces 410A and 410B within the housing which are bonded and connect to conductive bands 405A and 405B once module 350 is installed into cavity 415. Conductive bands 405A and 405B in turn connect to pads 365C and 365D via traces 370C and 370D. The differential-signal capability of module 350 is needed when connecting to differential signals or when referencing one signal to the next, such as required with phase-lock loops where the coincidence of one frequency source is compared with the coincidence of an opposing frequency source. Other applications of two-inputs for module 350 can be for the inverting and non-inverting inputs of an operational amplifier or two inputs for a logic function such as an OR, AND or XOR logic function. In addition, module 350 can serve as a differential input device with a single-output or a single-input device with differential outputs. Such applications include the translation of differential signals to single-ended signals or the translation of single-ended signals to differential signals. When differential signals enter module 350 from (the ends represented with) caps 385A and 385B, single ended signals can be output from either (the ends represented with) caps 385C or 385D, or both. Alternatively when differential signals enter module 350 from (the ends represented with) caps 385C and 385D, single ended signals can be output from either (the ends represented with) caps 385A or 385B, or both. Alternatively a differential-signal input can be processed by an active device and the output connected to another active device in the interface array via a pair of intermediate traces, in a manner similar to that of the single-ended modules 130F and 130G of FIG. 5C. Other alternatives for module 350 can include tandem-signal outputs such as an oscillator or temperature-measuring device having differential outputs and requiring no signal inputs.

In the practice of this invention a method is provided to insert modules into a housing panel comprised of openings to process, isolate, buffer or generate signals being input into an integrated circuit or multi-chip module or process, isolate or buffer signals being output from an integrated circuit or multi-chip module, whether the signals are single-ended or differential in nature. The geometry to which is being interfaced by the interface connector is not restricted to ball-grid, land-grid or column-grid arrays but can easily be adapted to other types of surface-mount devices comprised of leads, including quad flat-pack devices. The only disadvantage of using leaded devices is the penalty in real estate for the number of connections per unit area.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. An electrical interface assembly comprising:

a housing panel comprising at least two electrically-conductive layers separated by insulating material;

a through-opening extending between opposite sides of the housing panel;

an interface module, disposed within the through-opening, configured with two flat opposite ends substantially parallel to and located respectively in correspondence with said opposite sides of the housing panel;

a pair of contact ends located respectively on the two flat opposite ends of said interface module facing outwardly from each of said opposite sides of the housing panel, said opposite contact ends in said interface module being made and arranged to provide electrical interface on opposing sides of said housing panel;

at least one active electronic device incorporated with said interface module having at least two electrical terminals representing two different nodes of an electrical circuit; and connecting means for electrically connecting the electrical terminals of said active electronic device to at least two corresponding destinations selected from a group including said electrically-conductive layers in the housing panel and said contact ends.

2. The interface assembly of claim 1 wherein said interface module includes an electrically-conductive cap on one of the contact ends.

3. The interface assembly of claim 1, wherein said electrical interface module includes a single-ended-signal interface module between said opposite sides of the housing.

4. The interface assembly of claim 3, wherein an output from the single-ended-signal interface module is connected to an input of a second single-ended-signal interface modules through one of said conductive layers.

5. The interface assembly of claim 1, wherein said electrical interface module includes a differential electrical interface module.

6. The interface assembly of claim 1, wherein said interface module comprises a single-contact end on one side of the housing panel and a two-contact end on the opposite side of the housing.

7. The interface connector assembly of claim 1, wherein the active electronic device is surface deposited onto the module.

8. The interface connector assembly of claim 1, wherein the active electronic device is implemented as a discrete component contained within the module.

9. The interface assembly of claim 8, wherein the discrete component includes contact pads for connection with said interface module.

10. The interface connector assembly of claim 9, wherein the discrete component is wire bonded to the interface module.

11. The interface connector assembly of claim 9, wherein the discrete component is directly connected to the interface module.

12. The interface assembly of claim 1, further comprising at least one additional through-opening in the housing panel; at least one additional interface module with corresponding additional contact ends, said at least one additional interface module being inserted within the at least one additional through-opening of the housing panel; and at least one additional connecting means for electrically connecting the at least one additional interface module to said electrically-conductive layers in the housing panel;

wherein the additional contact ends provide additional electrical signals.

13. The interface assembly of claim 12, wherein said interface module and additional interface module are adapted to process differential signals and the interface module is connected to the additional interface module through separate traces in the conductive layers.

14. An electrical signal-source assembly comprising:

a housing panel with at least two electrically-conductive layers separated by insulating material;

a through-opening across opposite sides of the housing panel;

a signal source module, disposed within the through-opening with a contact end facing one of said opposite sides of the housing panel, including signal source means for generating an electrical signal available at the contact end; and connecting means for electrically connecting the signal-source means to said electrically-conductive layers in the housing panel.

15. The signal-source assembly of claim 14, wherein said contact end includes an electrically-conductive cap.

16. The signal-source connector assembly of claim 14, wherein the signal source means is surface deposited onto the signal-source module.

17. The signal-source connector assembly of claim 16, wherein the signal source means comprises at least one integrated circuit.

18. The signal-source connector assembly of claim 16, wherein the signal source means comprises a single-ended signal source.

19. The signal-source connector assembly of claim 16, wherein the signal source means comprises a differential signal source.

20. The signal-source connector assembly of claim 16, wherein the signal source means comprises an oscillator.

21. The signal-source connector assembly of claim 16, wherein the signal source means comprises a temperature-measuring device.

22. The signal-source assembly of claim 14, further comprising at least one additional through-opening in the housing panel; at least one additional signal-source module with a corresponding additional contact end, said at least one additional signal-source module being inserted within the at least one additional through-opening of the housing panel; and at least one additional connecting means for electrically connecting the at least one additional signal-source module to said electrically-conductive layers in the housing panel;

wherein the additional contact end provides an additional electrical signal.

* * * * *